US006073278A

United States Patent [19]

Ball

[11] Patent Number: 6,073,278

[45] Date of Patent: Jun. 13, 2000

[54] SNAP ON FLUID OVERFLOW PLATE FOR BATHTUBS

[75] Inventor: William T. Ball, Leawood, Kans.

[73] Assignee: WCM Industries, Inc., Colorado Springs, Colo.

[21] Appl. No.: 09/259,537

[22] Filed: Mar. 1, 1999

[51] Int. Cl.[7] ..... E03C 1/224

[52] U.S. Cl. ..... 4/694

[58] Field of Search ..... 4/694, 680; 285/46; D23/254

[56] References Cited

U.S. PATENT DOCUMENTS 321,504 7/1885 Jackson ..... 4/694

1,436,027 11/1922 Ferris ..... 285/46

2,640,672 6/1953 Bedford ..... 285/46

5,123,123 6/1992 Hart et al. ..... 4/694 X

*Primary Examiner*—Charles E. Phillips

*Attorney, Agent, or Firm*—Zarley, McKee, Thomte, Voorhees & Sease

[57] ABSTRACT

An overflow plate assembly for tubs has an outlet port associated with a drain pipe. A mounting plate is secured to the port. A fluid overflow plate has an inner and outer surface. A pair of prongs are secured to the inner surface and extend into suitable mounting openings in the mounting plate to frictionally secure the overflow plate to the mounting plate.

6 Claims, 2 Drawing Sheets

SNAP ON FLUID OVERFLOW PLATE FOR BATHTUBS

BACKGROUND OF THE INVENTION

Every modern bathtub has an overflow outlet to prevent the water level in the tub from overflowing in the event that the inlet faucet is inadvertently left in an open position. The overflow outlet is connected to the conventional drain system for the tub and is typically located at an elevated position at the end of the tub. The overflow outlet normally has a mounting plate associated therewith, and an overflow plate is secured to the mounting plate by screws or the like.

As a result, the installation of the overflow plate requires the use of one or more screws and a screw driver, which always must be used to install or replace the overflow plate.

It is therefore a principal object of the invention to provide an overflow plate that can be easily installed or removed without having to use special tools or fastening means such as screws.

This and other objects will be apparent to those skilled in the art.

SUMMARY OF THE INVENTION

An overflow plate assembly for tubs has an outlet port associated with a drain pipe. A mounting plate is secured to the port. A fluid overflow plate has an inner and outer surface. A pair of prongs are secured to the inner surface and extend into suitable mounting openings in the mounting plate to frictionally secure the overflow plate to the mounting plate.

DESCRIPTION OF THE PREFERRED EMBODIMENT

Figure 1:
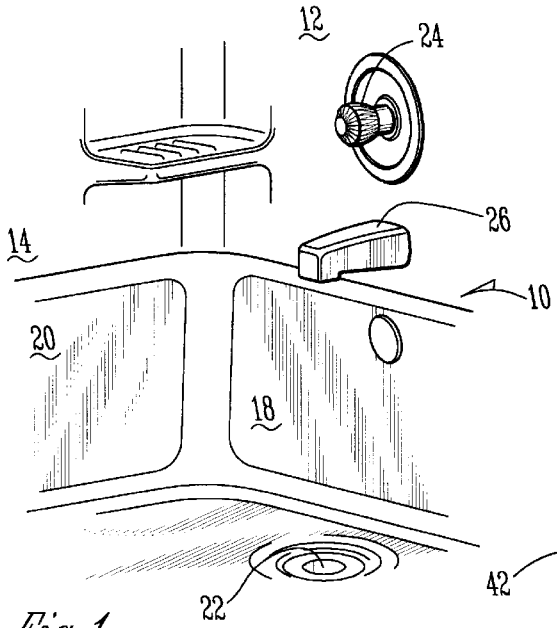
FIG. 1 is a partial perspective view of a tub having the overflow plate assembly of the invention.
Figure 2:
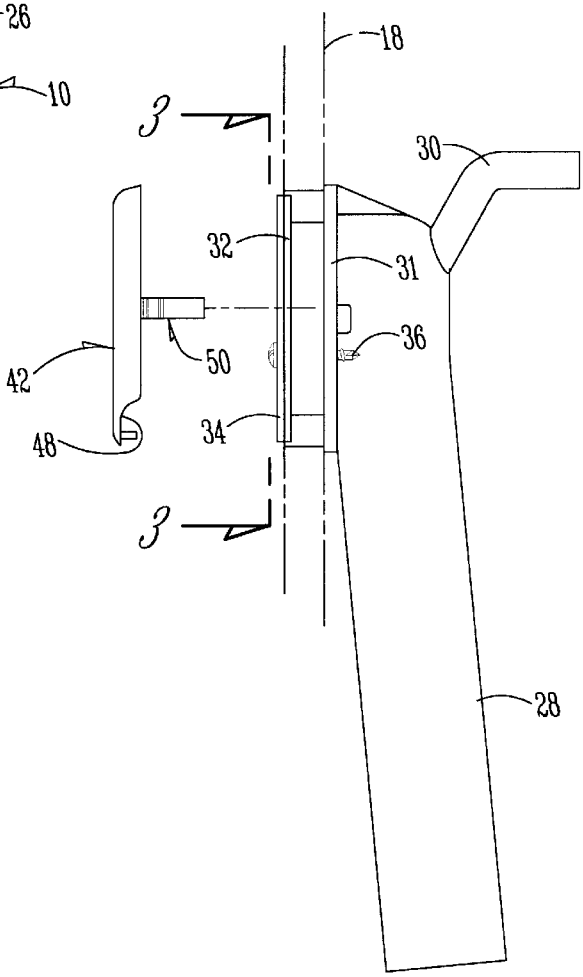
FIG. 2 is an enlarged scale exploded side view of the overflow assembly.

A bathtub ("tub") 10 is mounted adjacent bathroom end wall 12 and sidewall 14, and has a bottom 16, tub end wall 18, and tub sidewall 20. A conventional tub drain outlet 22 is located in bottom 16. A conventional water control valve 24 and water outlet 26 are mounted on end wall 12.

Figure 3:
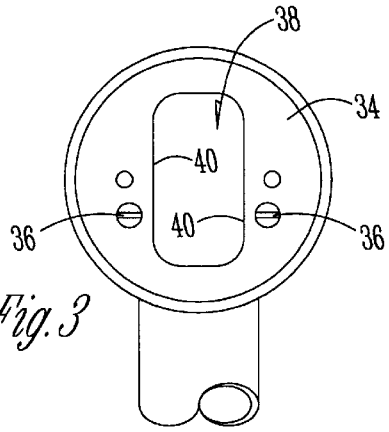
FIG. 3 is an elevational view of the mounting plate taken on line 3—3 of FIG. 2.

A conventional vertical drain pipe 28 is located in end wall 12 and is vented at 30. An inlet port 31 at the upper end of pipe 28 is surrounded by a conventional flange 32 (with center opening 32A) to which mounting plate 34 is secured by screws 36. Mounting plate 34 has a center opening 38 (FIG. 3) with vertical side edges 40.

Figure 4:
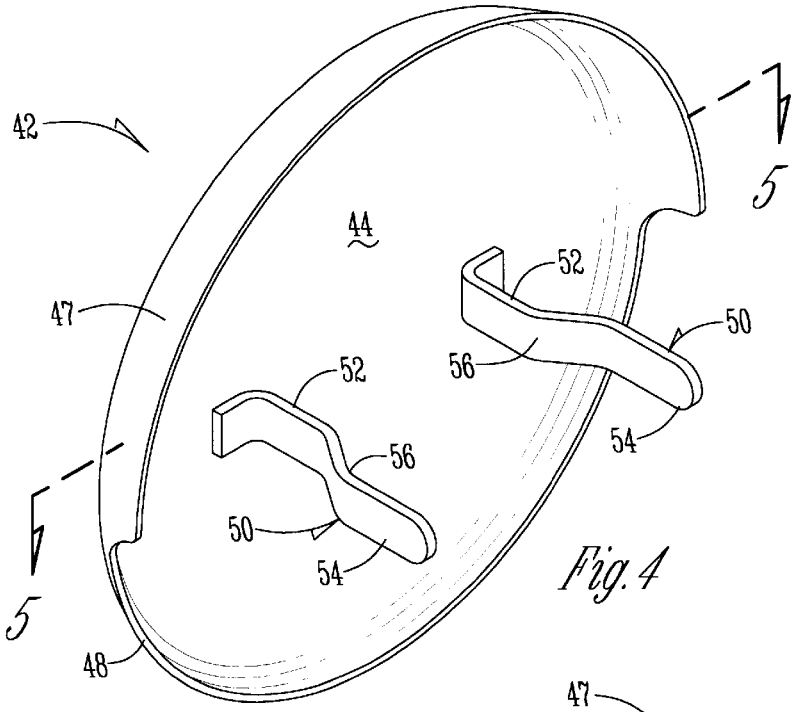
FIG. 4 is an enlarged scale perspective view of the overflow plate showing its inner surface.
Figure 5:
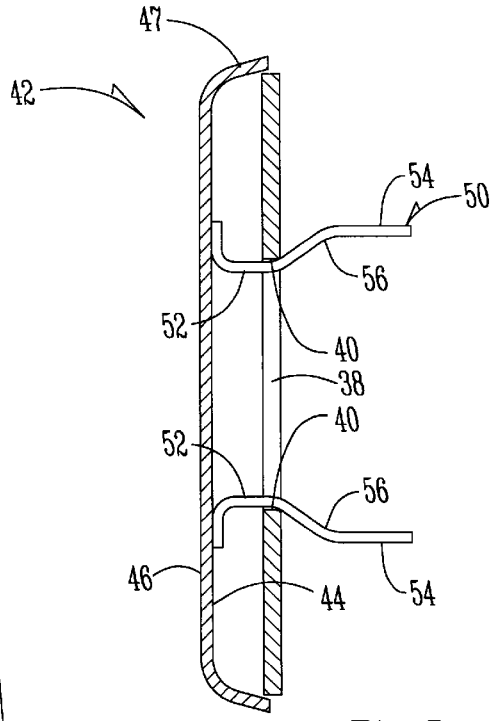
FIG. 5 is a sectional view taken on line 5—5 of FIG. 4.
Figure 6:
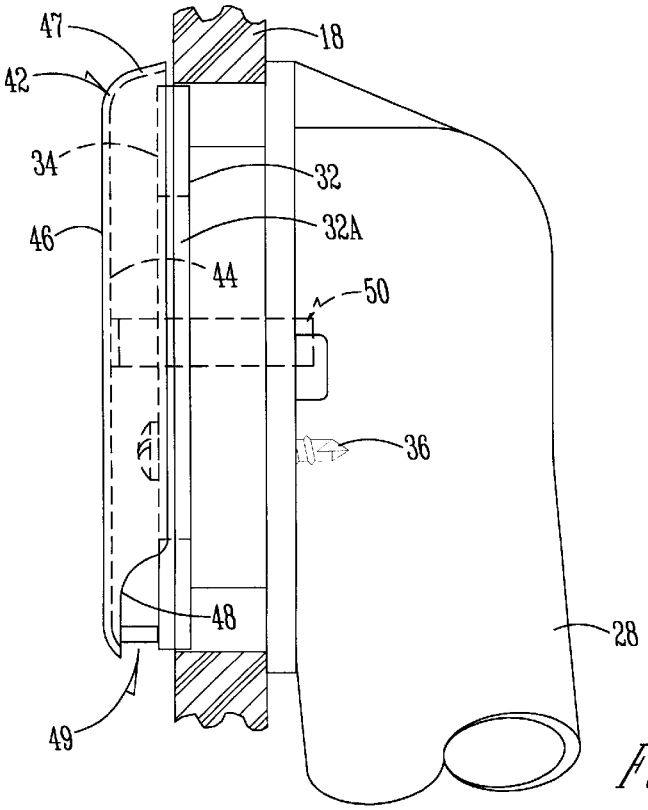
FIG. 6 is a vertical sectional view of the assembled mechanism.

Overflow plate 42 (FIGS. 4 and 5) has an inner surface 44 and an outer surface 46. The plate 42 is preferably circular in shape and has an inwardly extending flange 47 on its upper periphery, and a smaller inwardly extending flange 48 on the lower periphery which creates a fluid passage 49 (FIG. 6) when assembled as discussed below.

A pair of spaced spring prongs 50 are secured to the inner surface 44 of overflow plate 42 and extend towards end wall 12. The straight portion 52 of prongs 50 are laterally spaced so as to frictionally engage the sides 40 of mounting plate 34 when the prongs are inserted into opening 40. This is accomplished by pinching the inner ends 54 of the prongs together to clear the side edges 40 of the mounting plate opening 38. The prongs, when so inserted in opening 38, spring back to the normal position so that portions 52 frictionally engage side edges 40. The upper edge of flange 47 can engage the upper edge of mounting plate 34 to determine the vertical height of the plate 42 and to prevent it from sliding downwardly with respect to the side edges 40 of the mounting plate. The overflow plate 42 can be removed from mounting plate 38 by pulling it outwardly from end wall 12 when the prongs 50 yieldingly collapse as they pass outwardly through opening 38 of the mounting plate. Diagonal portions 56 facilitate the removal as they engage side edges 40.

It is therefore seen that the plate 42 can be easily and quickly installed on or removed from mounting plate 38 without the use of any tools or separate fastening elements, whereby the objectives of the invention are fully met.

What is claimed is:

1. An overflow plate for bathtubs, comprising:

a circular overflow plate having inner and outer surfaces, an inwardly curved flange means on a periphery of the plate, a pair of spaced prongs extending away from the inner surface, the prongs having first parallel straight segments, and outer parallel end segments, the end segments being spaced a greater distance than the straight segments; and the straight segments being each connected to the end segments by diagonally extending segments.

2. An overflow plate assembly for bathtubs, comprising:

a vertical mounting plate attached to an inlet port of a vertical drain pipe, a circular overflow plate positioned adjacent the mounting plate and having an inner surface adjacent the mounting plate, a pair of prongs extending away from the inner surface of the overflow plate and resiliently and detachably slidably engaging supporting surfaces on the mounting plate so that the overflow plate can be detachably secured to the mounting plate solely by the engagement of the prongs with the supporting surfaces, the prongs having first parallel straight segments, and outer parallel end segments, the end segments being spaced a greater distance than the straight segments; and the straight segments being each connected to the end segments by diagonally extending segments.

3. An overflow plate assembly for bathtubs, comprising:

a vertical mounting plate attached to an inlet port of a vertical drain pipe, a circular overflow plate positioned adjacent the mounting plate and having an inner surface adjacent the mounting plate, a pair of prongs extending away from the inner surface of the overflow plate and resiliently and detachably slidably engaging supporting surfaces on the mounting plate so that the overflow plate can be detachably secured to the mounting plate solely by the engagement of the prongs with the supporting surfaces, the prongs having first parallel straight segments, and outer parallel end segments, the end segments being spaced a greater distance than the straight segments; and the straight segments being each connected to the end segments by diagonally extending segments.

4. An overflow plate assembly for bathtubs, comprising:

a vertical mounting plate attached to an inlet port of a vertical drain pipe, a circular overflow plate positioned adjacent the mounting plate and having an inner surface adjacent the mounting plate, a pair of prongs extending away from the inner surface of the overflow plate and resiliently and detachably slidably engaging supporting surfaces on the mounting plate so that the overflow plate can be detachably secured to the mounting plate solely by the engagement of the prongs with the supporting surfaces;

the mounting plate having a center opening with straight side edges, with said prongs slidably and frictionally engaging the side edges to detachably hold the overflow plate on the mounting plate.

5. The assembly of claim 4 wherein the prongs have first parallel straight segments, and outer parallel end segments, the end segments being spaced a greater distance than the straight segments.

6. The assembly of claim 5 wherein the straight segments are each connected to the end segments by diagonally extending segments.

* * * * *